US007828535B2

(12) United States Patent
Notis

(10) Patent No.: US 7,828,535 B2
(45) Date of Patent: Nov. 9, 2010

(54) PRESSURE SEALED TAPERED SCREW PUMP/MOTOR

(76) Inventor: Alan Notis, 1789 Decatur Rd., Mohegan Lake, NY (US) 10547-1629

( * ) Notice: Subject to any disclaimer, the term of this patent is extended or adjusted under 35 U.S.C. 154(b) by 573 days.

(21) Appl. No.: 11/817,036

(22) PCT Filed: Mar. 9, 2006

(86) PCT No.: PCT/US2006/008524

§ 371 (c)(1),
(2), (4) Date: Aug. 24, 2007

(87) PCT Pub. No.: WO2006/099104

PCT Pub. Date: Sep. 21, 2006

(65) Prior Publication Data

US 2008/0138230 A1 Jun. 12, 2008

Related U.S. Application Data

(60) Provisional application No. 60/660,224, filed on Mar. 10, 2005.

(51) Int. Cl.
*F03C 2/00* (2006.01)
*F03C 4/00* (2006.01)
*F04C 2/00* (2006.01)

(52) U.S. Cl. ..... 418/194; 418/9; 418/144; 418/195; 418/201.1

(58) Field of Classification Search ..... 418/9, 418/10, 104, 107, 140, 144, 191, 194, 195, 418/201.1
See application file for complete search history.

(56) References Cited

U.S. PATENT DOCUMENTS 3,116,871 A 1/1964 Mishina et al.

(Continued)

FOREIGN PATENT DOCUMENTS

DE 19820523 11/1999

(Continued)

OTHER PUBLICATIONS

FR 789211 A—English Translation.*

*Primary Examiner*—Theresa Trieu
(74) *Attorney, Agent, or Firm*—Fox Rothschild LLP; Richard C. Woodbridge; Perry M. Fonseca

(57) ABSTRACT

A fluid pump (10) or motor (100) includes a pair of enmeshed tapered rotors (22,24,122,124) having intersecting axes of rotation. The first rotor (22,122) includes a small low pressure end (34,54,134,154) and a larger high pressure end (32,52, 132,152) and a spiral thread (36,56,136,156) that increases in width and depth as it progresses from the high pressure end (28,128) to the low pressure end (26,126). The second rotor (24,124) enmeshes with the first rotor (22,122), and has an identical structure, except that its threads (36,56,136,156) progress in the opposite direction. Both rotors (22,24,122, 124) are mounted on sliding splines (42,62,142,162) which permit them to move, to a limited extent, into and out of their respective receiving cavities. The pressure on the high side (28,128) of the pump (10) or motor (100) tends to urge the rotors (22,122,24,124) against the walls (16,20,116,120) of the receiving cavities thereby improving their sealing capabilities and the overall efficiency of the pump (10) or motor (100) as a whole.

24 Claims, 16 Drawing Sheets

U.S. PATENT DOCUMENTS

| | | | |
|---|---|---|---|
| 4,792,294 | A | 12/1988 | Mowli |
| 4,952,125 | A | 8/1990 | Nagai |
| 5,533,887 | A | 7/1996 | Maruyama |
| 6,019,586 | A | 2/2000 | Liou |
| 6,129,534 | A | 10/2000 | Schofield et al. |
| 6,217,305 | B1 | 4/2001 | Schofield et al. |
| 6,257,839 | B1 | 7/2001 | Fang et al. |
| 6,379,135 | B2 | 4/2002 | Schofield et al. |
| 6,672,855 | B2 | 1/2004 | North |
| 2001/0024620 | A1 | 9/2001 | North |
| 2001/0041145 | A1 | 11/2001 | North |
| 2001/0051101 | A1 | 12/2001 | Schofield |

FOREIGN PATENT DOCUMENTS

| | | | | | |
|---|---|---|---|---|---|
| EP | 1 130 263 | A2 | | 9/2001 | |
| FR | 789211 | A | * | 10/1935 | ..... 418/194 |
| FR | 2684417 | A1 | | 6/1993 | |
| JP | 01267384 | A | | 10/1999 | |
| JP | 2000 073976 | A | | 3/2000 | |
| JP | 2001 304156 | A | | 10/2001 | |

* cited by examiner

PRESSURE SEALED TAPERED SCREW PUMP/MOTOR

CROSS REFERENCE TO RELATED APPLICATIONS

This application claims the priority of PCT/US2006/008524 filed on Mar. 9, 2006, and provisional U.S. application Ser. No. 60/660,224 filed Mar. 10, 2005 and entitled "The Tapered Screw Pump" by Alan Notis, the entire contents and substance of which are incorporated in total herein by reference.

BACKGROUND OF THE INVENTION

1. Field of the Invention

This invention relates to dual screw-type motors and pumps in general, and, in particular, to both dry and lubricated vacuum pumps, pneumatic and air-conditioning compressors, hydraulic pumps, pneumatic motors, and hydraulic motors.

2. Description of Related Art

The prior art includes a number of efforts to produce effective screw-type rotor pumps and motors. In some rare cases, the rotor is tapered and the flights of the screw portion are graduated so as to be wider at one end.

Perhaps most typical of these special cases is the pump described in U.S. Pat. No. 6,672,855 issued to Michael Henry North on Jan. 6, 2004 and illustrated in FIG. 1 as Prior Art. In this design the inner-cone diameter, referred to as the "root diameter", increases as the screw moves from the inlet side to the outlet side. This design appears to allow for improved volume compression characteristics. The varying pitched threads also allow for greater pumping speed at relatively "low" (under 50 mbar) inlet pressures as well.

A similar earlier effort is described in U.S. Pat. No. 6,019,586 which discloses a screw compressor/pump including a graduated, contracted screw portion. The patent refers to "an inner cone tapered towards a suction port side", and a rotor chamber "defining an outer cone tapered toward the discharge port side, thus forming a gradationally contracted cavity between the spiral groove and the conical wall surface of the rotor chambers." The result is a pump/compressor which provides for volume compression as well as a shortening of the rotor and shaft. This design appears to improve pump sealing characteristics somewhat, but the patent reference only states that "the helix tooth has its top land surface approximating very closely to the inside wall of the rotor chamber to minimize the clearance and gas leakage."

Of possible lesser relevance is the device described in U.S. Publication US 2001/0041145 A1, which discloses a vacuum pump including a body, a pumping chamber, and tapered rotors.

The general state of the art can also be found in the following: U.S. Pat. Nos. 4,952,125; 6,129,534; 6,217,305; and, 6,379,135. Note also the following U.S. Publications: 2001/0024620 A1; 2001/0041145 A1; and, 2001/0051101 A1. In addition note the following patent applications or references: Japanese Patent/Application 2001/304,156; 2000/073,976; and, 01267384. Also European application number 1130263 A1 and French patent number 2684417A1.

There tends to be the following shortcoming with regard to the foregoing prior art for screw-type pumps and motors:

First, they often have poor sealing characteristics, resulting in excessive energy consumption and lower pumping efficiency. This especially becomes a problem over time, because the gaps between enmeshed screws become larger as friction wears the screws against each other.

Second, they tend to have large rotor size and shaft sizes compared to their pumping capacities. Pump/motor size to output ratio is thus an issue.

Third, while some of the cited tapered screw pumps have limited volume compression, standard screw pumps have no volume compression along the rotor length. This makes it difficult to use such pumps/motors for gas applications, and also requires more power consumption than a pump which achieves compression along the rotor.

Fourth, such pumps/motors tend to have limited pressure differential for low viscosity flows.

The device described in U.S. Pat. No. 6,672,855 and some others attempt to address some of these issues, and while such inventions are useful, their versions still suffer from other significant drawbacks:

First, the pump designs do not relieve pressures within the pump that exceeds the high-side pressure. At the start of pump operations, when both sides are at the same pressure, the pump internally may develop pressures higher than the "high pressure" side. This causes a large loss of efficiency, and diminishes the seal which slows down pumping action. U.S. Pat. No. 6,672,855 suggests the use of an electronic regulator to reduce shaft speed at the initial stages of pump operation to minimize the problem, but at the cost of slower pumping speed.

Second, the outer cone, i.e. "thread diameter" taper described in U.S. Pat. Nos. 6,672,855 and 6,019,586 both work against optimal sealing efficiency. As the pumps operate, the pressure differential from the high side to the low side will naturally tend to push the screws out of the block, i.e. the rotor chamber. With respect to vacuum pumps, at the start of the pumping cycle, the intra-cavity pressure is higher than the output pressure (atmospheric pressure); thus the problem is exacerbated. The inventions described in U.S. Pat. Nos. 6,672,855 and 6,019,586 both include a truncated cone with the wider diameter at the inlet, i.e. low, pressure side. In a two dimensional view, the block is a trapezoid with the longer length at the inlet side. The outlet, i.e. high, pressure side tends to force the rotors out of the block, which reduces sealing characteristics between the block edge and the threads.

While both such prior art devices can adequately handle the pressure differential required for vacuum pumps (about 14.7 psi or 760 mmHg), both are unfit for pumping across much larger pressure differentials. In gas compressors, for instance, the pressure differential could be as large as 5,000 psi.

SUMMARY OF THE INVENTION

The present invention comprises a tapered screw pump/motor in which both the inner cone, i.e. root, and the outer cone, i.e. thread, diameters increase when progressing from the low pressure to the high pressure sides of the device. The result is that the screw axes are not parallel, as is common in the prior art. This configuration of the block and screws now use the pump/motor's pressure differential to enhance sealing properties. This results in a pump/motor which can achieve pressure differentials much greater than those found in the prior art.

The pitch of the screw threads of the present invention varies across the length of the rotors. The pitch change is quite steep compared to that found in existing tapered screw machines. By achieving volume compressions comparable to or exceeding that of existing prior art pumps/motors by using fewer threads, a shorter, more compact pump size is achieved.

This present invention can achieve volume compression ratios ranging from 1:1 to 15:1.

The present invention also introduces the concept of pressure relief valves/devices within the rotor cavities. Prior art devices acknowledge the problem of having "too many compressive forces across the screw mechanism" but seek to mitigate the problem by adding electronic devices to reduce pumping speeds (and thus yielding a slower output) for the starting interval. Pressure relief valves maximize pump efficiency by reducing internal pressure. When the compressive forces exceed the high pressure side, the relief valves open and lower the pump internal pressure to essentially the same pressure of the high side. In a vacuum pump, this allows for a greater volume differential for the same sized motor.

The invention may be more fully understood by referring to the following drawings.

DETAILED DESCRIPTION OF THE INVENTION

During the course of this description like numbers will be used to identify like elements according to the different views that illustrate the invention.

Figure 1:
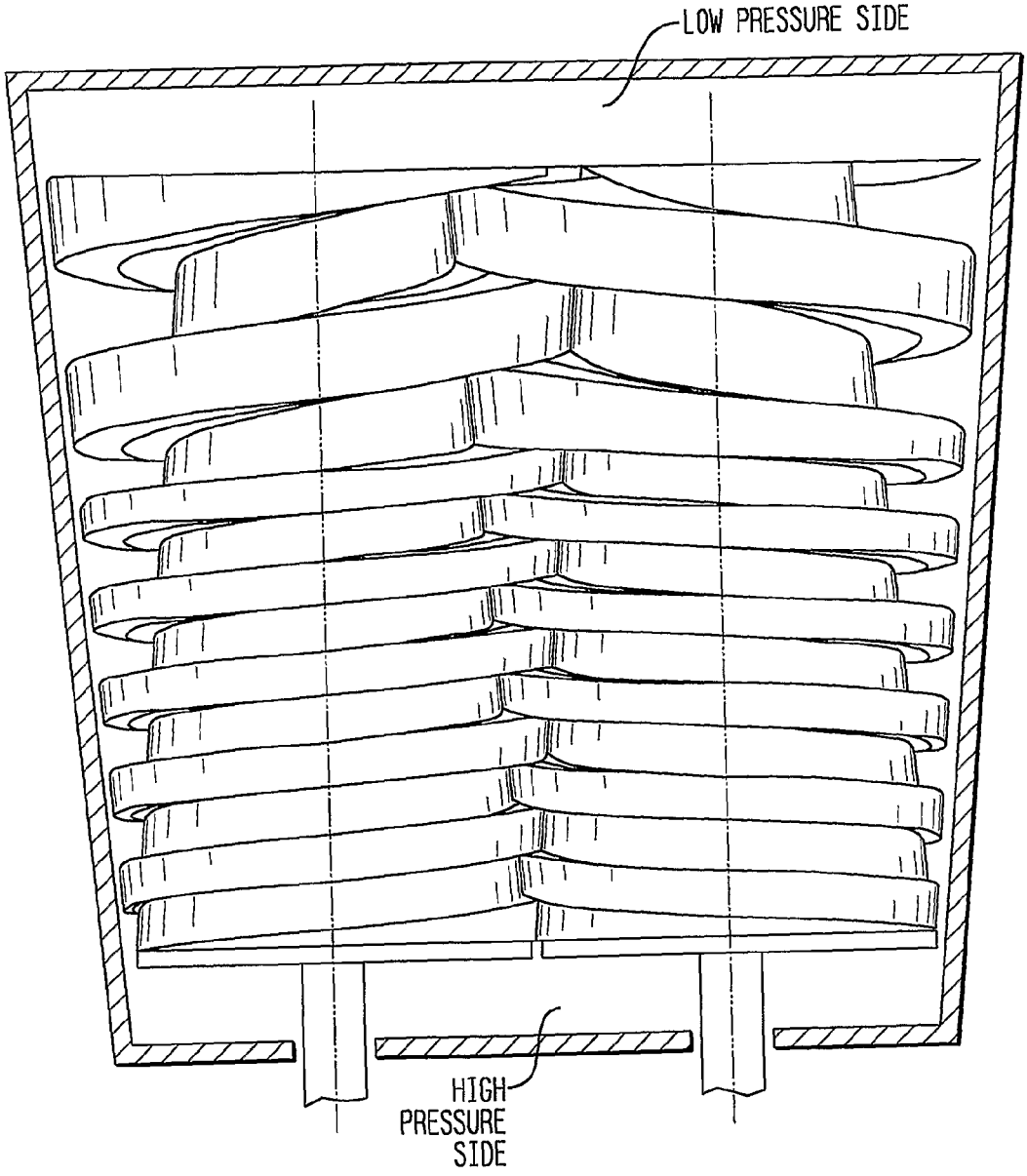
FIG. 1 (PRIOR ART)
FIG. 1 illustrates a prior art tapered screw vacuum pump such as described in U.S. Pat. No. 6,672,855.

As previously discussed, FIG. 1 illustrates a prior art Tapered Dual Screw Pump of the sort described in U.S. Pat. No. 6,672,885. The screws are complimentary, i.e. one is a right-handed thread and the other one is a left-handed thread. The core of the rotor taper decreases from the high-side to the low-side as the thickness of the thread increases. Note also that the axes of rotation of both rotors are parallel. Since the high-side is on the tapered end of the pump, the natural tendency is for the high pressure to push the dual screws out of the cavity. This tends to decrease their sealing capability and, accordingly, decrease its efficiency. The dual screw pump illustrated in FIG. 1 is typical of the prior art.

Figure 2:
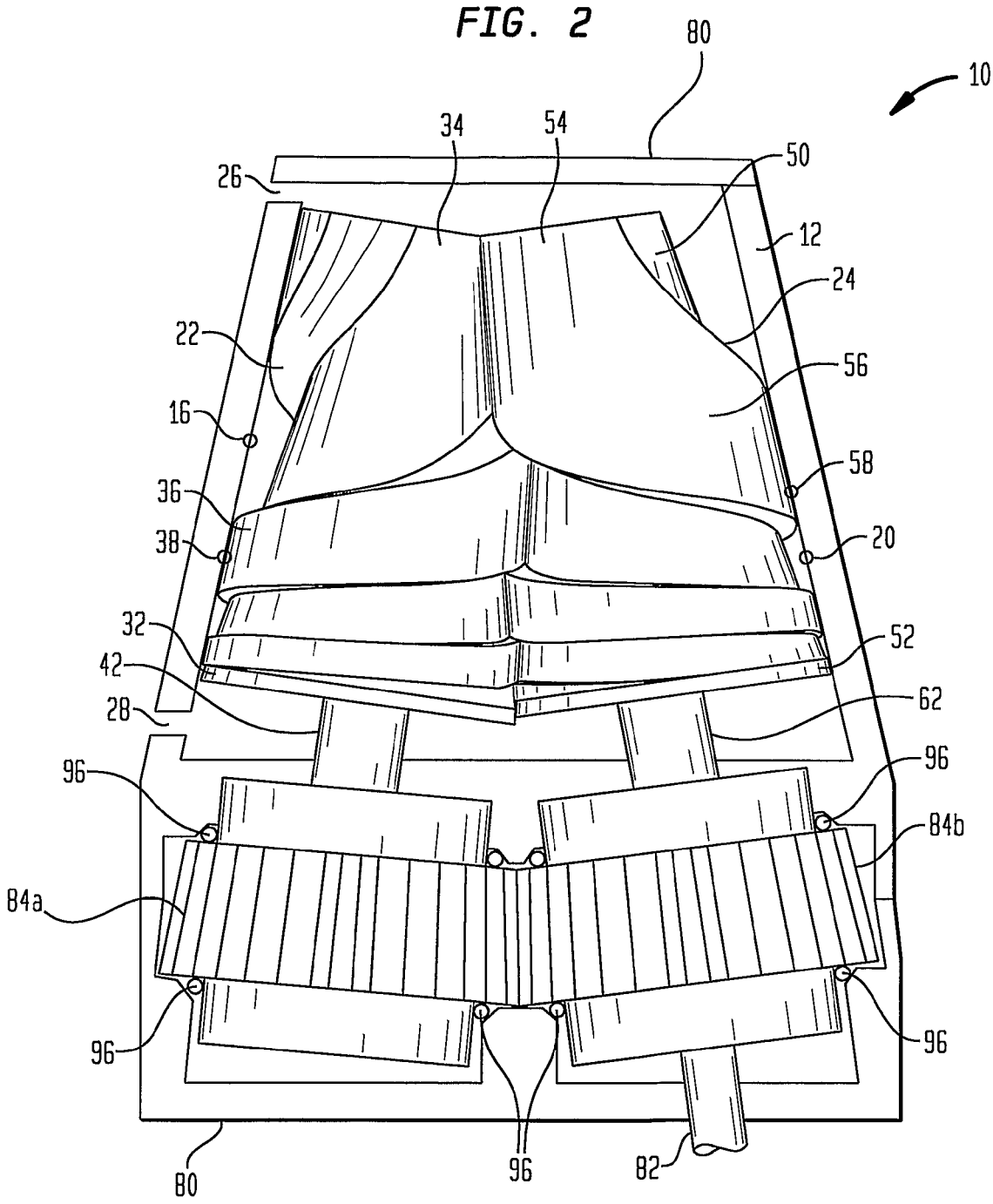
FIG. 2 illustrates the basic vacuum pump configuration of the preferred embodiment of the invention which, in some cases, could also be a configuration for a motor or load at the high pressure side.
Figure 2A:
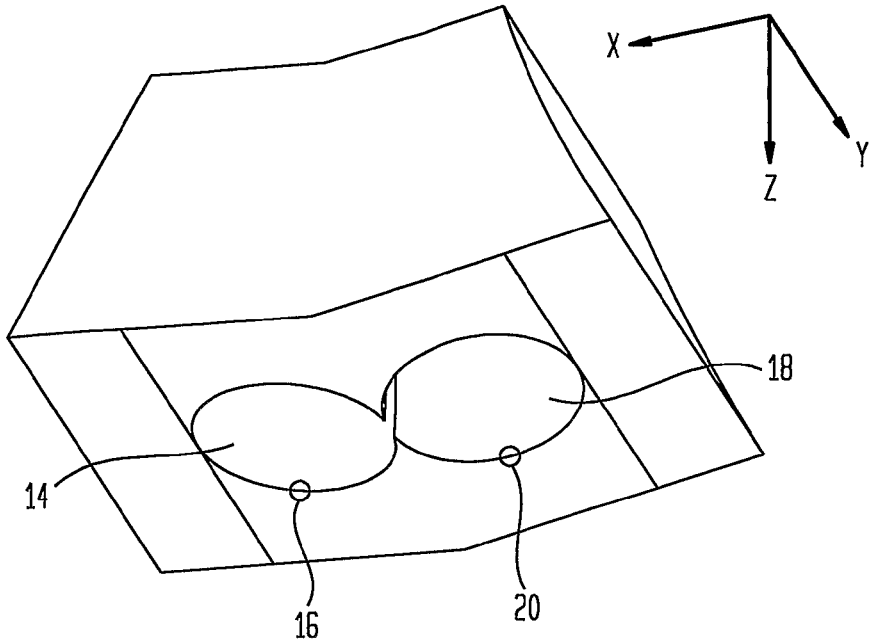
FIGS. 2A-2B illustrate the block and tapered cavities in a vacuum pump configuration.
Figure 2B:
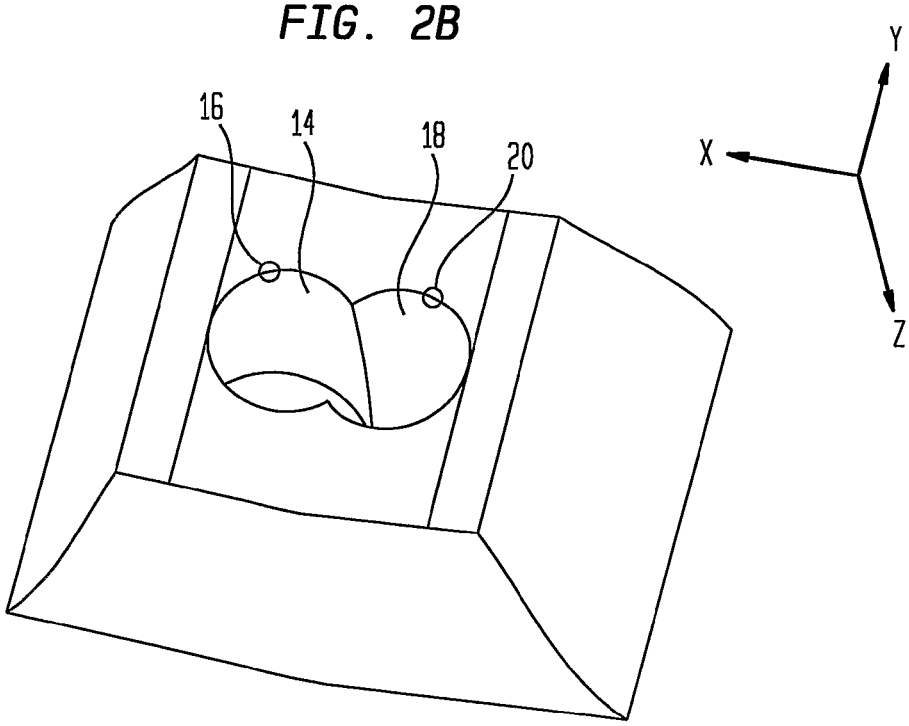
Figure 2C:
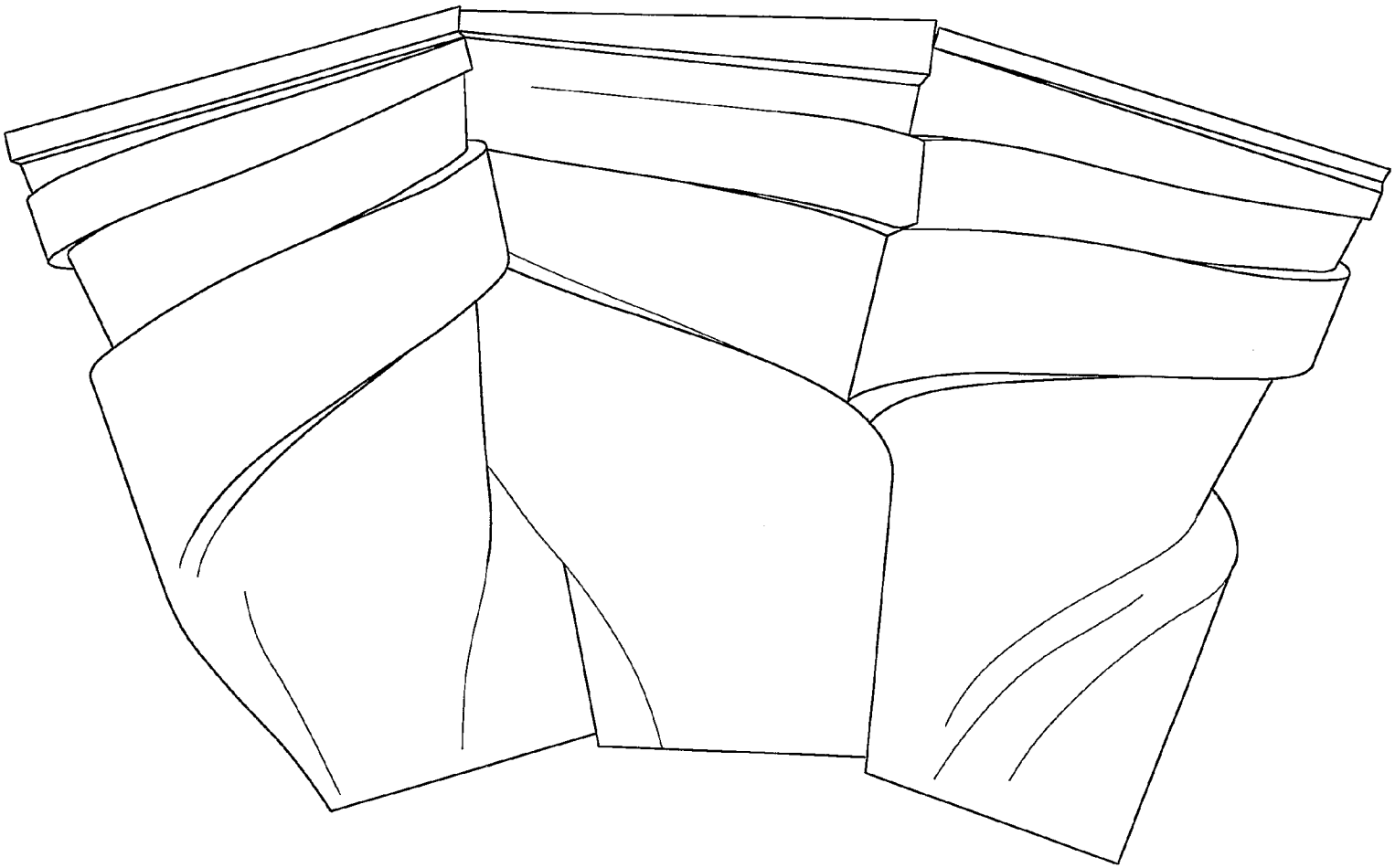
FIG. 2C illustrates a three rotor embodiment.
Figure 2D:
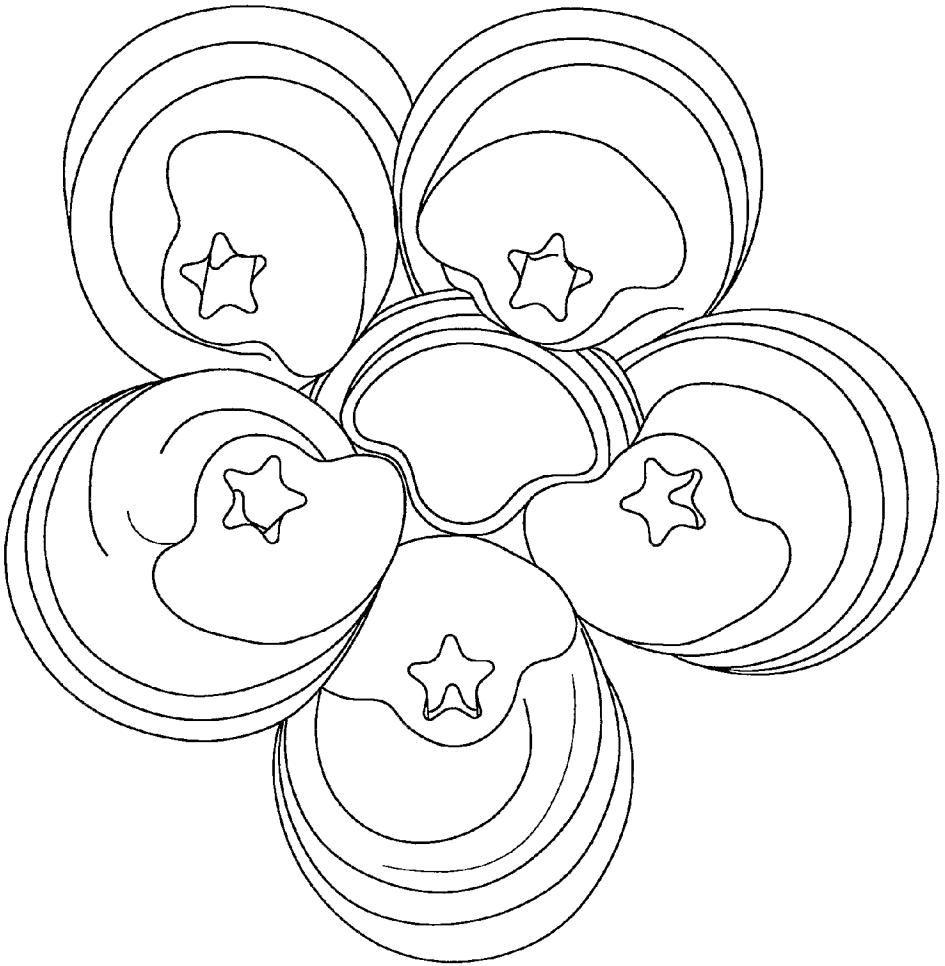
FIG. 2D illustrates a six rotor embodiment including at least one driven rotor.
Figure 3:
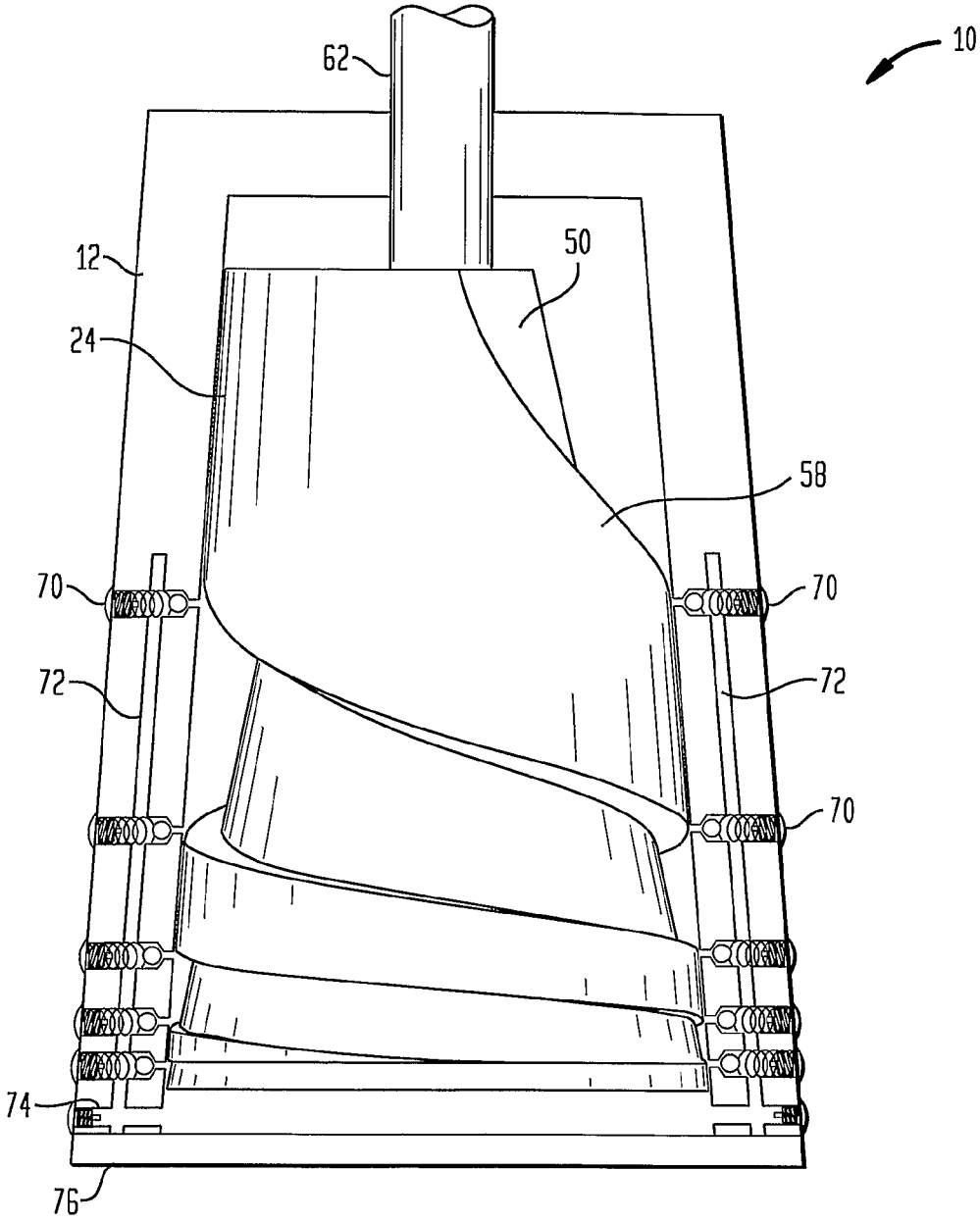
FIG. 3 is a side elevational view of the pump configuration illustrated in FIG. 2.
Figure 4:
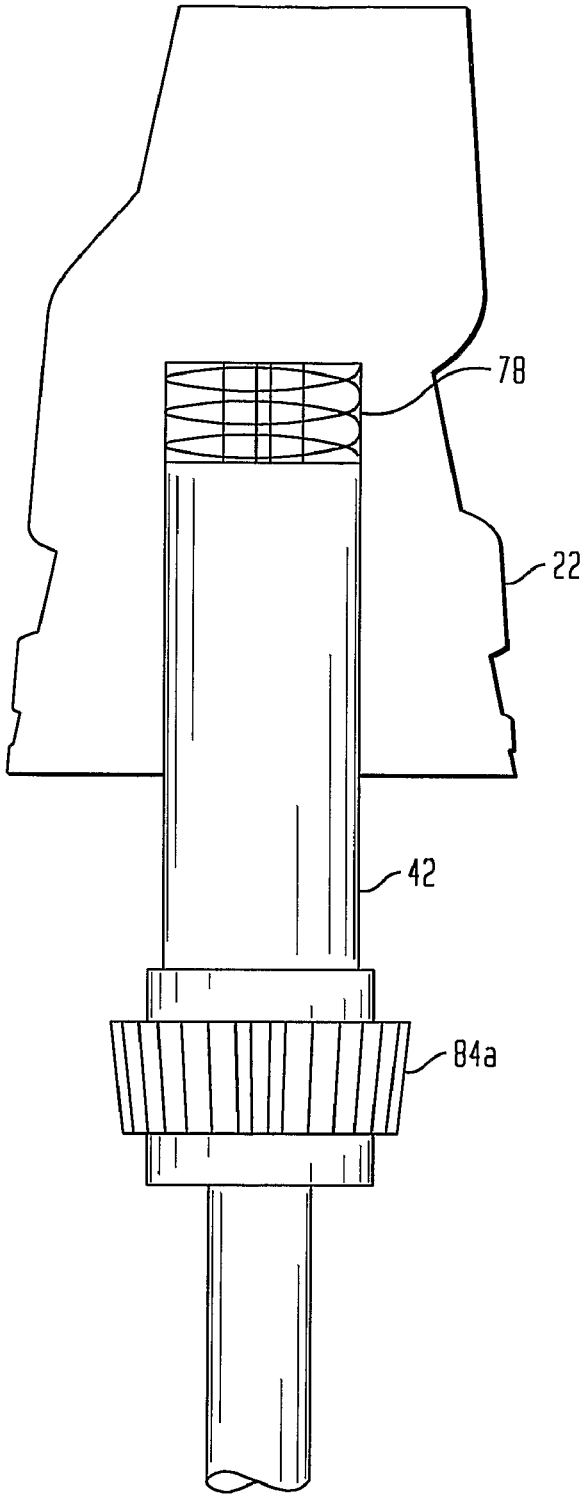
FIG. 4 is a cross-sectional view of the rotor (i.e. screw) and sliding spline including a load/driving motor on the high pressure side.

A pump 10 according to the preferred embodiment of the invention is illustrated in FIGS. 2-4. The pump invention 10 includes a pump block 12 having a first cavity 14 including a cavity wall 16 and a second cavity 18 having a second cavity wall 20. A first rotor 22 fits snugly in the first cavity 14 and comes into sealing contact with first cavity wall 16. Similarly, a second rotor 24, having threads of the opposite hand with respect to the first rotor 22, and meshing therewith, sits in the second cavity 18 and comes into sealing contact with the cavity walls 20 of the second cavity 18. The pump 10, according to the preferred embodiment of the invention, like almost all pumps, includes a low pressure side 26 and a high pressure side 28.

Figure 11A:
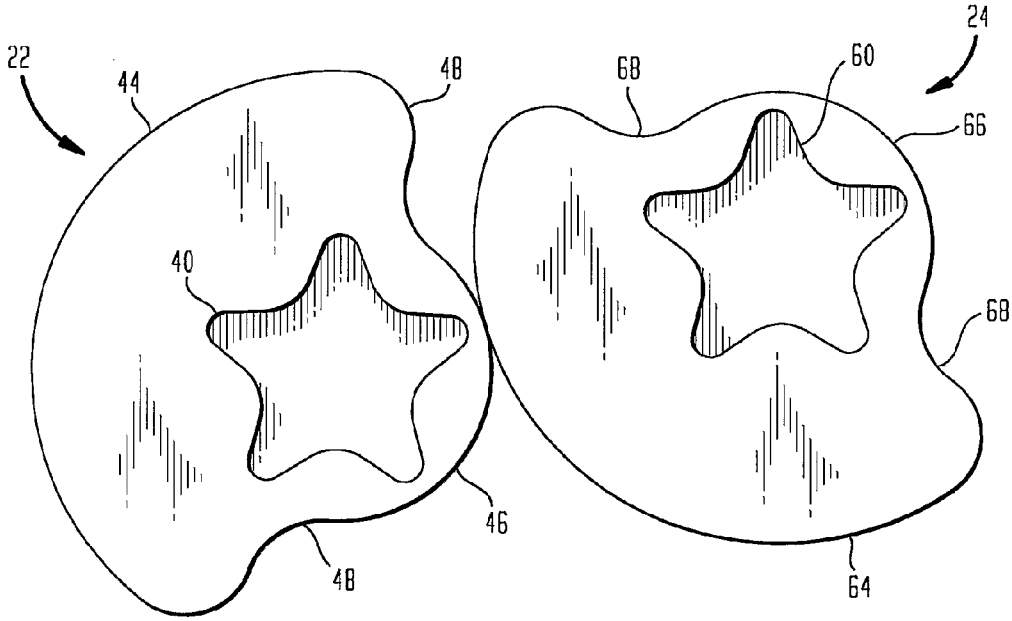
FIGS. 11A and 11B illustrate how the small ends of the rotors interact with each other.
Figure 11B:
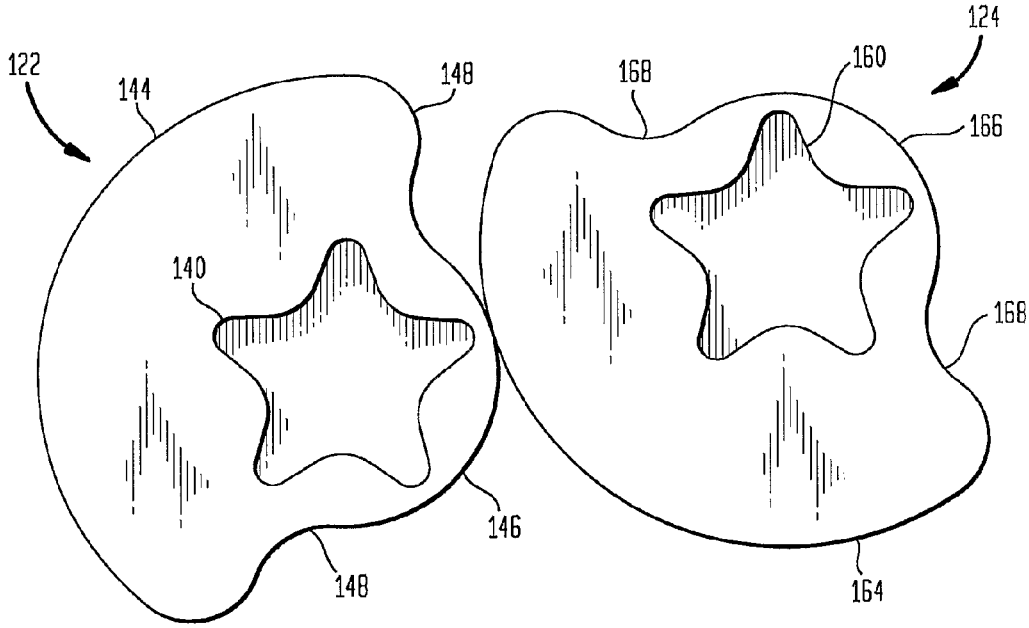

The construction of the first and second rotors 22 and 24, respectively, are very similar. First rotor 22 includes a tapered core 30, a large end 32 and a small end 34. A first spiral flight 36 progresses from the low pressure, side 26 to the high pressure side 28. The spiral flight 36 is thickest closer to the low pressure end 26 and becomes more narrow as it progresses towards the large end 32 near the high pressure side 28. First rotor 22 includes a spiral outer edge 38 that contacts the walls 16 of the first cavity. A spline receiving cavity 40 is located inside of the long axis of the first rotor 22. Spline receiving cavity 40 is intended to accept a spline attached to shaft 82 as shown in FIG. 2. The small end 34 of rotor 22 includes a face having a larger outer segment 44, a smaller inner segment 46, and a pair of "S" shaped transition zones 48 as shown in FIG. 11A. Spline 42 includes a bevel gear 84*a* which engages with another bevel gear 84*b* connected to the second rotor 24 via spline 62.

The second rotor 24 has a structure almost identical to that of the first rotor 22 except that it has a thread twist of the opposite hand from the first rotor 22 and it is not connected to a drive shaft 82. Similar to rotor 22, the second rotor 24 includes a tapered core 50 which is widest at its large end 52 and smallest at its small end 54. Second rotor spiral flight 56 surrounds the core 50 and travels in a hand opposite from the spiral flight 36 on the first rotor 22 but meshes therewith in a relatively tight sealing arrangement. The spiral flight 56 includes an outer surface 58 that contacts wall 20. A spline receiving cavity 60 is located along the long axis of the second rotor 24. The small end face 54 includes a larger outer segment 64, a small inner segment 66, and a pair of "S" shaped transition zones 68.

A plurality of relief valves 70 connected to relief passages 72 are shown in FIG. 3. Relief passages 72 extend to and through port 74 which is attached to a removable high pressure head 76. Rotors 22 and 24 are biased by compression springs 78.

Figure 6:
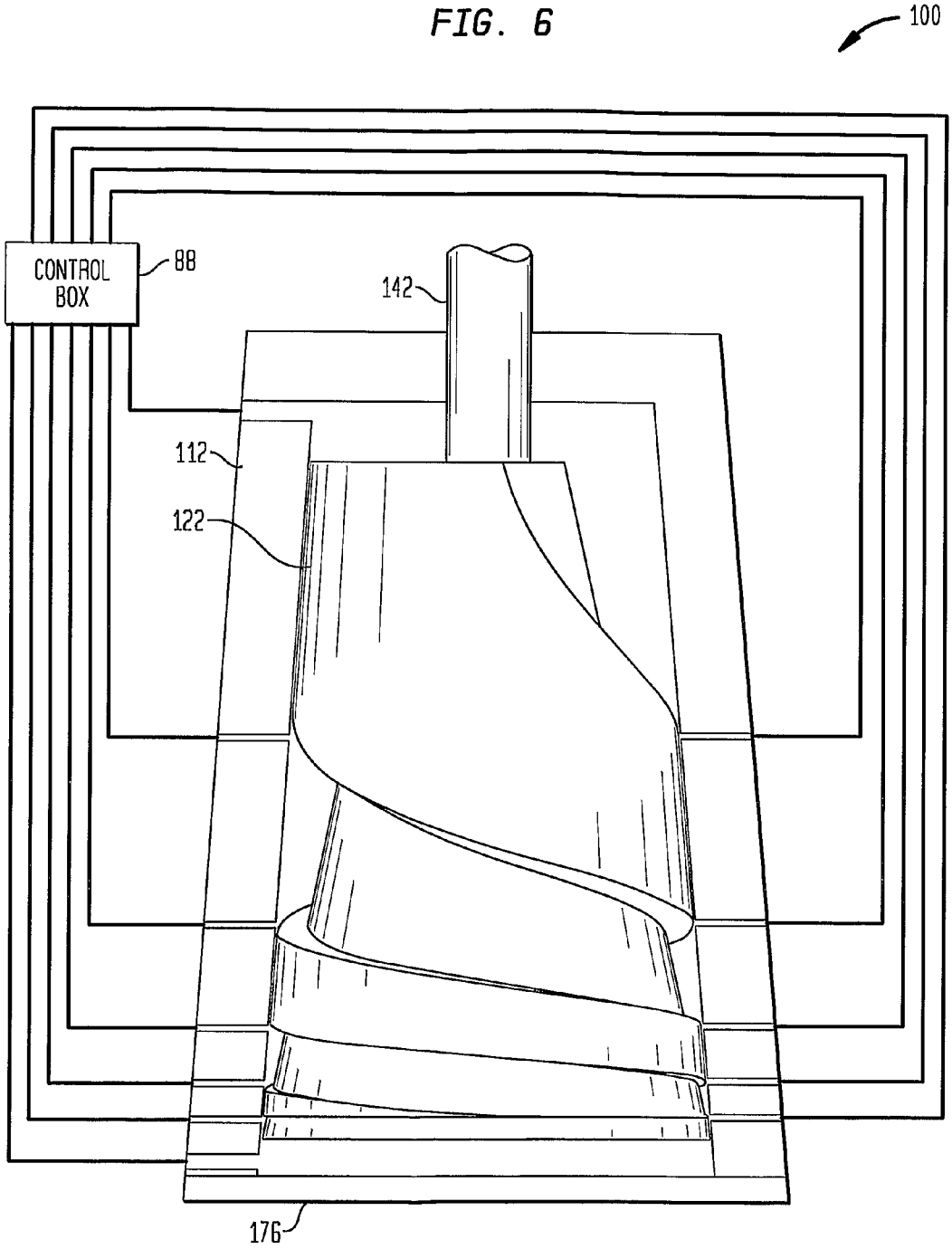
FIG. 6 illustrates a side elevational view of the basic motor configuration illustrated in FIG. 5 and including a control circuit.

As shown in FIG. 2 a removable section (or piece) 80 is located at the high pressure end of pump 10. Removal of section 80 permits access to bevel gears 84*a* and 84*b* as well as to bearings 96. Conversely, if the device 10 is operated as a motor, then shaft 82 effectively becomes an output shaft. It is evident from the foregoing that the splines 42 and 62 ride inside of the cavities 40, 60 under the influence of pressure on the high side of the large end surfaces 32, 52. The motor version of 10 or 100 can be controlled by a control box 88 as shown in FIG. 6. The controls of control box 88 are similar to those of a conventional motor control system, opening and closing valves in response to torque/speed requirements.

Bevel gears 84*a*, 84*b* sit on ball bearings 96 so that they are free to rotate. Splines 42, 62 ride in and out of the spline receiving cavities 40, 60 and in the pump version bias screws 22, 24 via tension spring 90, which sits on a spline nut 92 held in place by a screw 94.

With the foregoing environment in mind, the pump version 10 and the motor version 100 of the present invention can be fully understood.

FIG. 2 shows the basic vacuum pump configuration 10, which in some cases could also be a configuration for a motor or load at the high-pressure side. Note that the axes are at an angle of between 0 and 60 degrees with respect to each other. In the vacuum pump configuration, the spiral flights comprise roughly three in number, whereas in the prior art there tend be more flights.

FIG. 3 is a side view of the basic pump configuration 10 where pressure relief valves 70 connect to passageways 72 and ultimately to port 74 on the high pressure side. Removable high pressure head section 76 allows for the installation and/or replacement of the rotors 22, 24.

FIG. 4 is a cross sectional view of rotor 22 and sliding spline assembly. Compression spring 78 urges the screw into the block on pump startup. One of the major features and advantages of the present invention is that the pressure on the high side of the invention tends to exert a force on the large end surfaces 32, 52 thereby forcing rotors 22, 24 into sealing engagements against the walls of the cavities 14, 18 in which they are located. This improves the seal and efficiency of the operation. The large ends 32,52 of the rotors 22,24 have a face which is relatively flat and takes up more than 70% of the area of the cavity in which it sits when in sealing engagement with the cavity. In an embodiment of the invention, the small ends 34,54 of the rotors 22,24 have a face that takes up more than 30% of the area of the low pressure side, but not more than 75% of the area.

Figure 5:
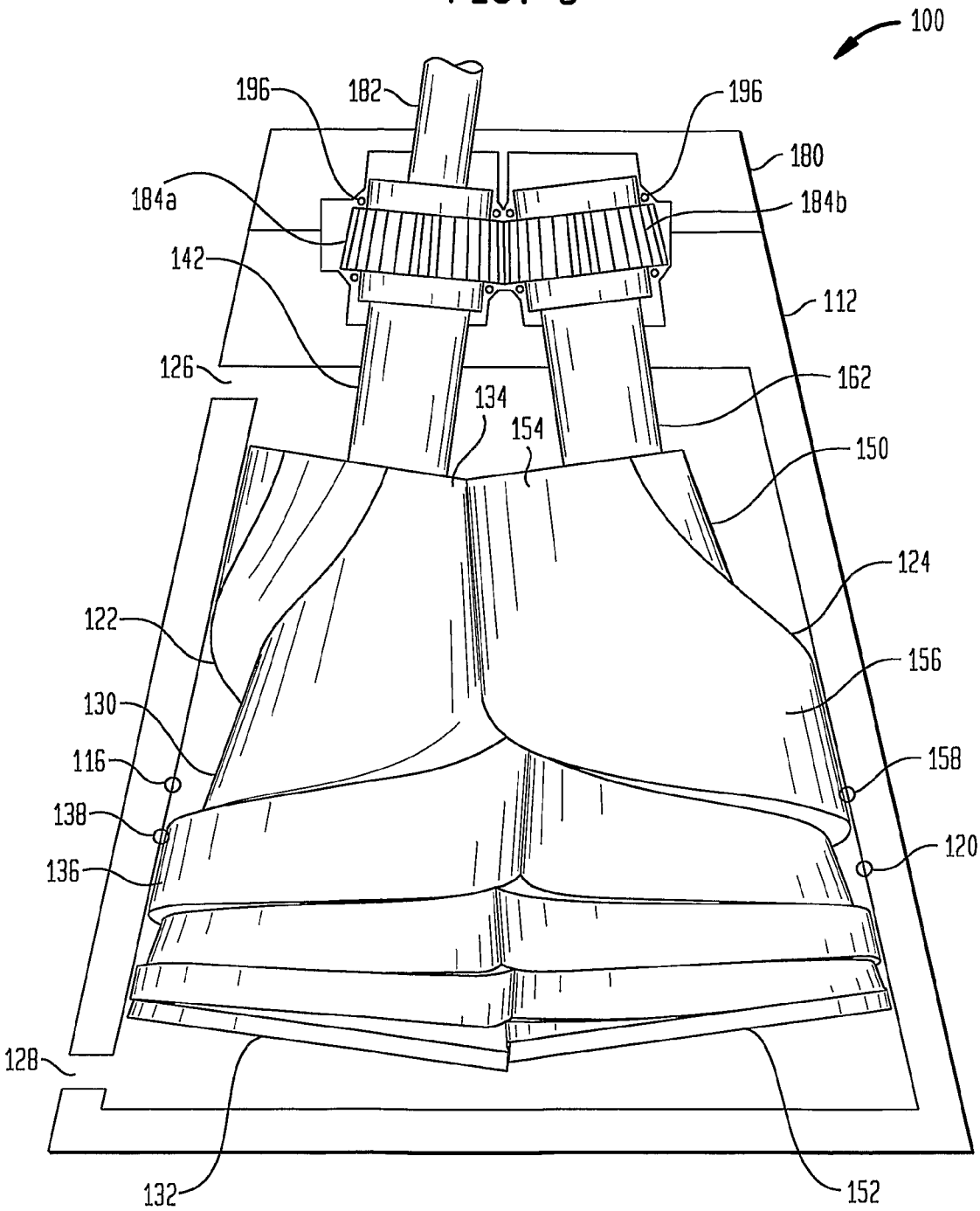
FIG. 5 illustrates the preferred embodiment of the invention when used as a motor/pump where the low pressure side is at atmospheric pressure.
Figure 5A:
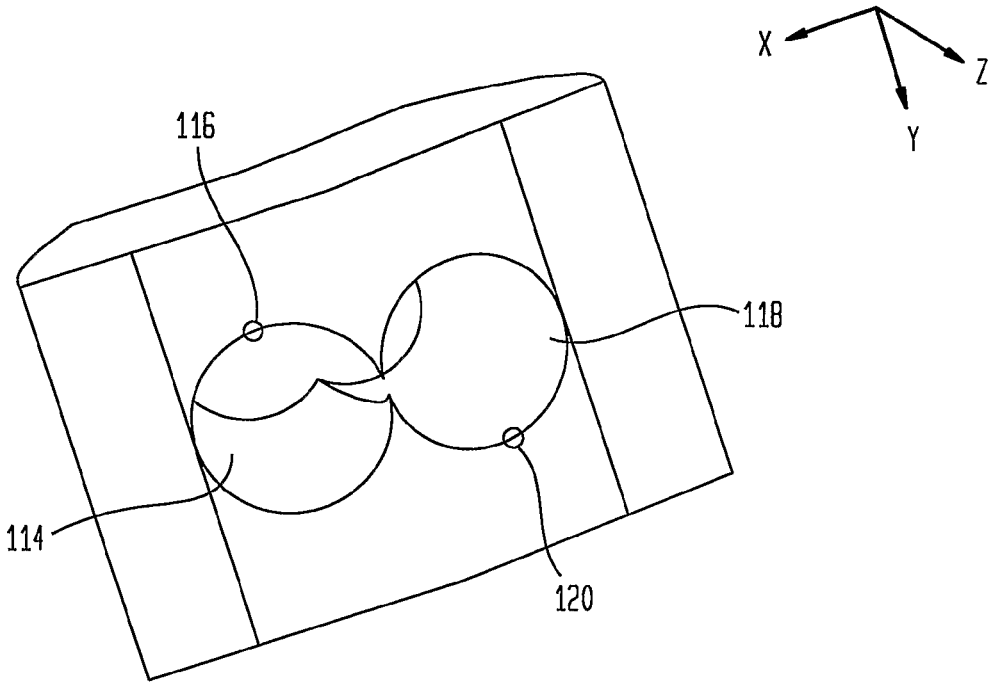
FIG. 5A is a top view of the block and tapered cavities in a motor/pump configuration.
Figure 7:
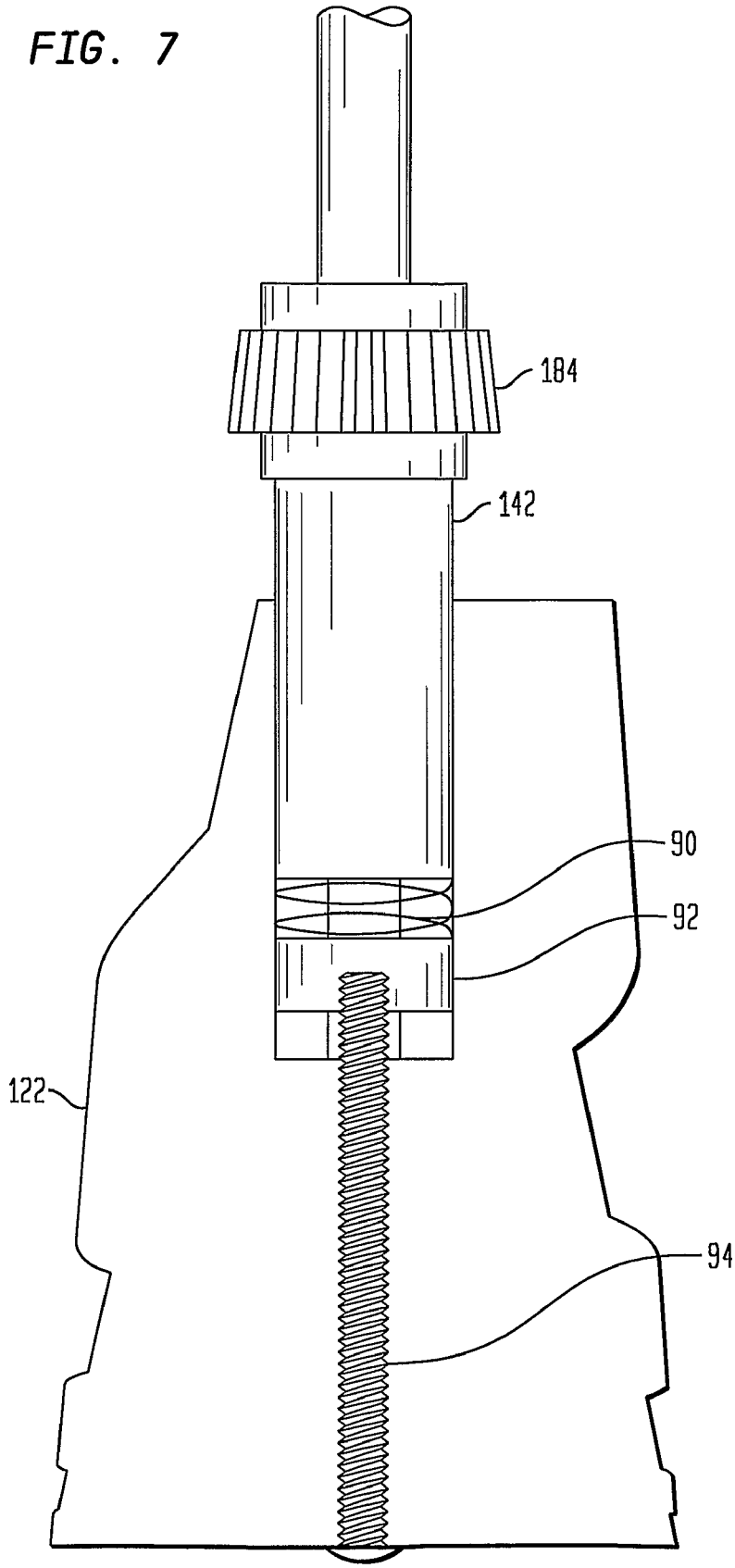
FIG. 7 is a cross-sectional view of the rotor (screw) and sliding spline of the load/motor on the low pressure side as shown in FIG. 5.

The arrangement of the elements in FIGS. 2-4 as a pump 10 can be modified slightly to yield excellent results as a motor/compressor 100 as illustrated in FIGS. 5-7.

The preferred embodiment of the motor version 100 includes a motor block 112 and a first cavity 114 having first cavity walls 116. The motor block 112 also includes a second cavity 118 having second cavity walls 120. A first rotor 122 is fit snugly in the first cavity 114 making sealing contact with the walls 116. Similarly, a second rotor 124 is fit snugly in the second cavity 118 making sealing contact with cavity walls 120. As is true also of the pumping embodiment 10, the motor 100 includes a low pressure side port 126 and a high pressure side port 128.

The first rotor 122 includes a first tapered core 130, a large end 132, and a small end 134. A first spiral flight 136 surrounds the tapered core 130. The outer edge 138 of the spiral flight 136 contacts walls 116. A spline 142 is received in cavity 140 in the first rotor 122. at Small end low pressure face 134 includes a larger outer segment 144, a smaller inner segment 146, and a pair of "S" shaped transition zones 148.

Similarly, the second rotor 124 is virtually identical to the first rotor 122, except that the direction of spiral flights 156 are opposite from those of spiral flights 136. The second rotor 124 includes a tapered core 150, a large end 152 and a small end 154. The second rotor spiral flight 156 includes an edge 158 that contacts the walls 120. A second rotor spline 162 is received in the spline cavity 160 in the second rotor 124. Like the first rotor 122, the second rotor 124 includes a small end having a large outer segment 164, a small inner segment 166, and a pair of "S" shaped transition zones 168. The large ends 132,152 of the rotors 122,124 have a face which is relatively flat and takes up more than 70% of the area of the cavity in which it sits when in sealing engagement with the cavity. In an embodiment of the invention, the small ends 134,154 of the rotors 122,124 have a face that takes up more than 30% of the area of the low pressure side 122, but not more than 75% of the area.

As shown in FIG. 6, the motor embodiment 100 includes tubing which goes to control box 88. This allows high pressure to enter various points in the cavities 114,118 or allows fluid out from those points to the low pressure side, controlling speed and torque. A removable high pressure head 176 permits access to the high pressure side. Bevel gears 184*a*, 184*b* are fitted into the splines 142, 162 and mesh with each other. A control box 88 controls the operation of motor 100. When embodiment 100 is used as a pump, tension spring 90 is attached to spline 142 at one end and spline nut 92 on the other end. Spline nut 92 is held in place by screw 94 to the rotor 122. This provides limited pressure to the screw against the block during compressor start-up.

FIG. 5 illustrates the basic configuration for the motor 100 according to the preferred embodiment where the low pressure side is at atmospheric pressure. Bearings 196 hold the splines 142, 162 in place. Low pressure side plate 180 is removable so that the bevel gears 184*a*, 184*b* and bearings 196 can be removed or maintained. In the motor embodiment 100, the output shaft 182 is connected to a load, while in the pump embodiment 10 the shaft 182 is connected to a drive motor. Bevel gears 184*a*, 184*b* distribute the load more evenly across both rotors 122, 124 to reduce screw-to-screw wear. The enmeshed rotors 122 and 124 rotate, forming a progressively changing volume allowing for internal expansion within the motor 100. The high pressure port is shown as item 128. The sliding splines 142,162 rotate, or are rotated by the rotors and allow the pressure differential to push the screws back against the block forming a positive seal.

FIG. 6 illustrates a side-view of a basic motor configuration 100, in cross-section, wherein the control box 88 controls the pressure from the high side to various points of the screw cavity volume through the fluid hoses. This allows for the control of torque and speed. In an application where the motors are in series, the output pressure can be controlled when less than full pressure is required.

FIG. 7 is another cross-sectional cut-away view of a screw and a sliding spline arrangement for the pump 100 on the low pressure side. The motor version of 100 would be identical to FIG. 7 except for the removal of tension spring 90, spline nut 92, and screw 94. The pressure differential is allowed to push the rotors 122, 124 against the block 112 forming a better seal while the rotors 122, 124 turn or are turned by the spline, in the pump embodiment.

The spline cavity 114 and 116 allows the rotors 122, 124 to settle into the block 112 as a result of the pressure differential. Tension spring 90 is used to pull the rotors 122, 124 into the block 124 during pump start up. On the other side of the tension spring is a spline nut 92. The spline nut is held in place by screw 94. The tension spring 90 is mechanically attached or soldered to the spline 142 or 162 and spline nut 92.

Figure 8:
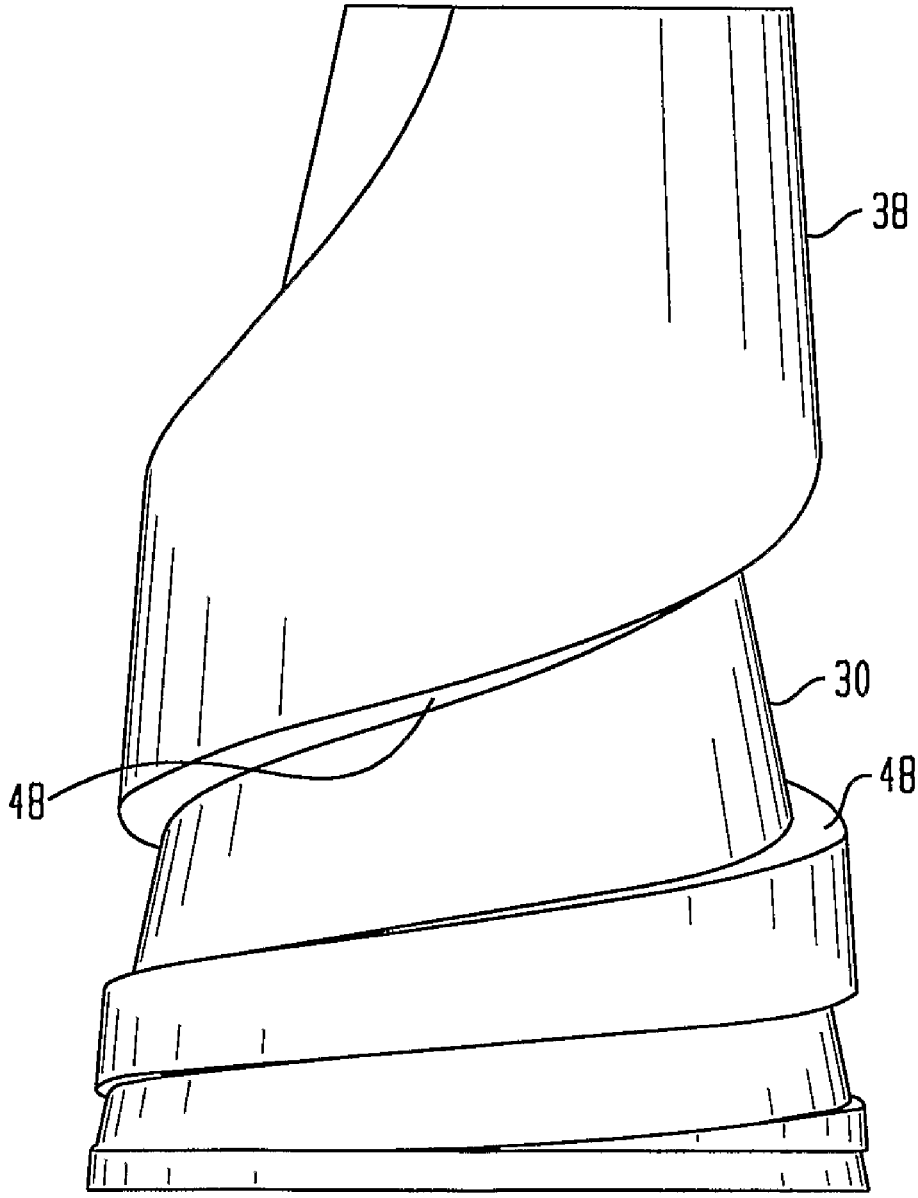
FIG. 8 illustrates a rotor (screw) component part in detail.
Figure 9A:
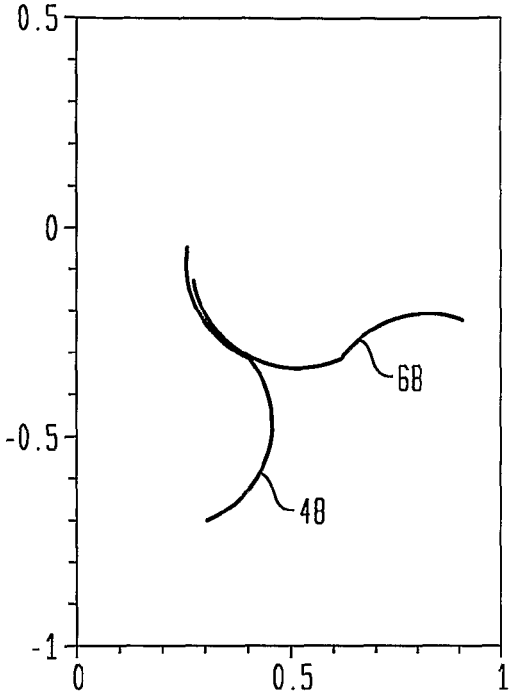
FIGS. 9A-9G illustrate the sliding, rotating seal characteristic maintained by the rotors in both the pump and the motor configurations.
Figure 9B:
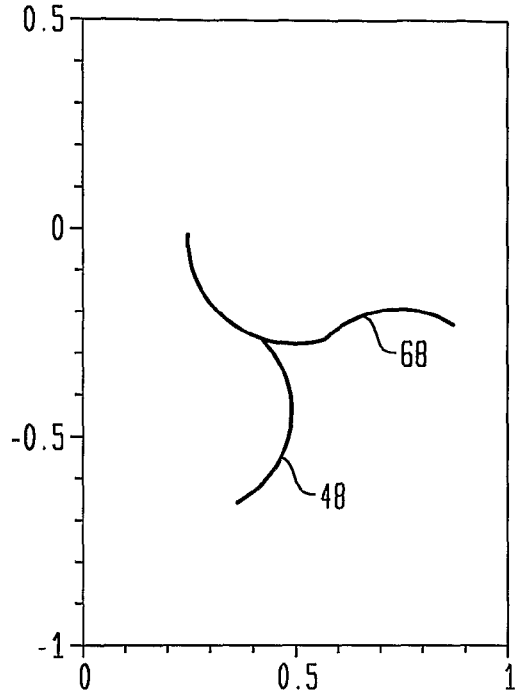
Figure 9C:
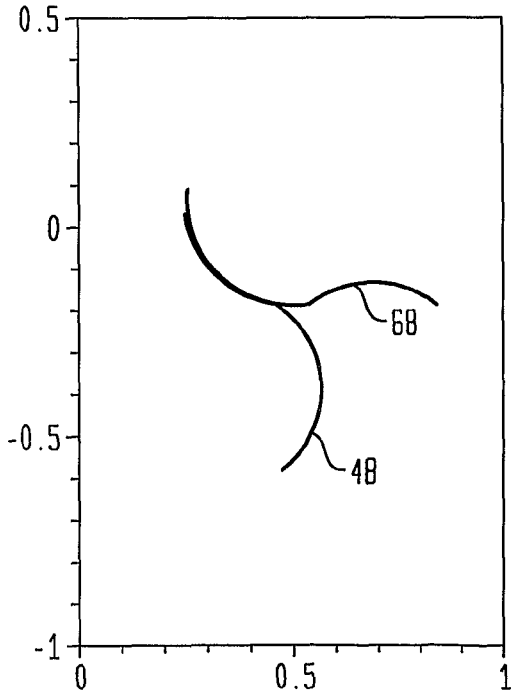
Figure 9D:
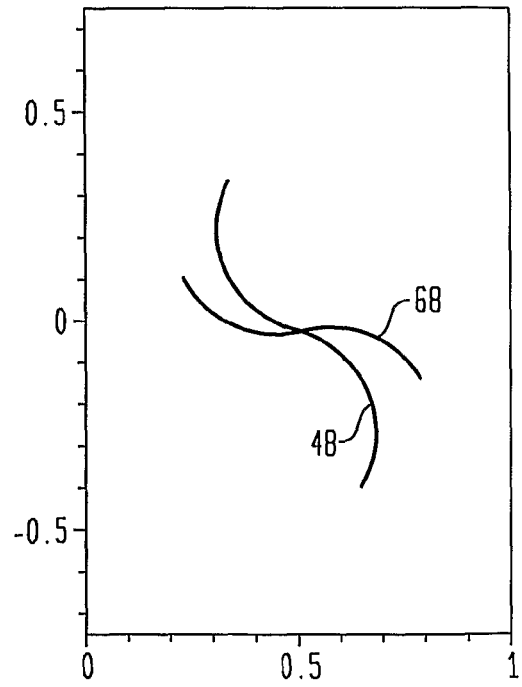
Figure 9E:
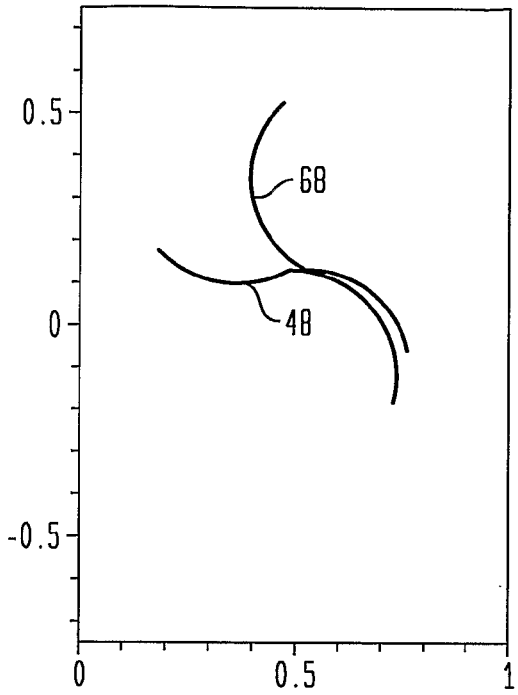
Figure 9F:
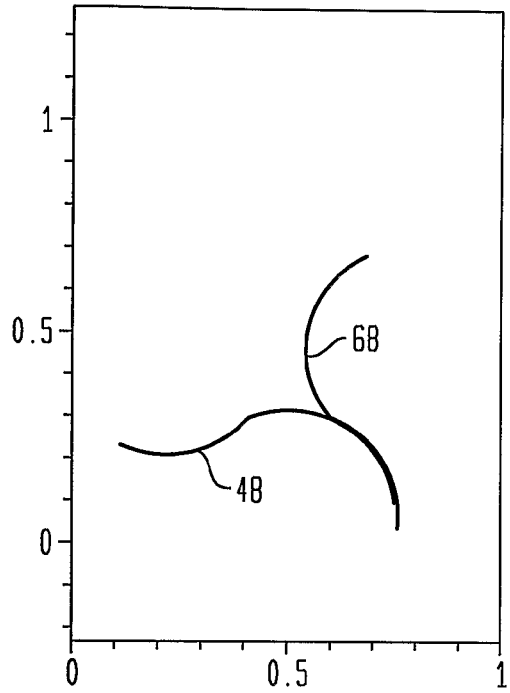
Figure 9G:
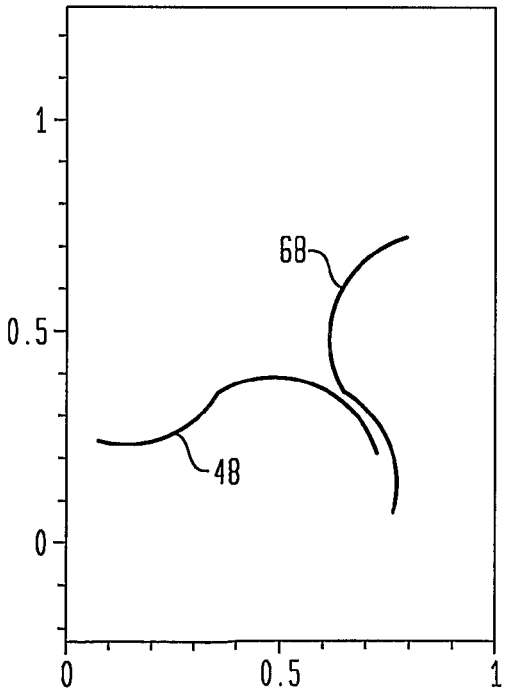
Figure 10:
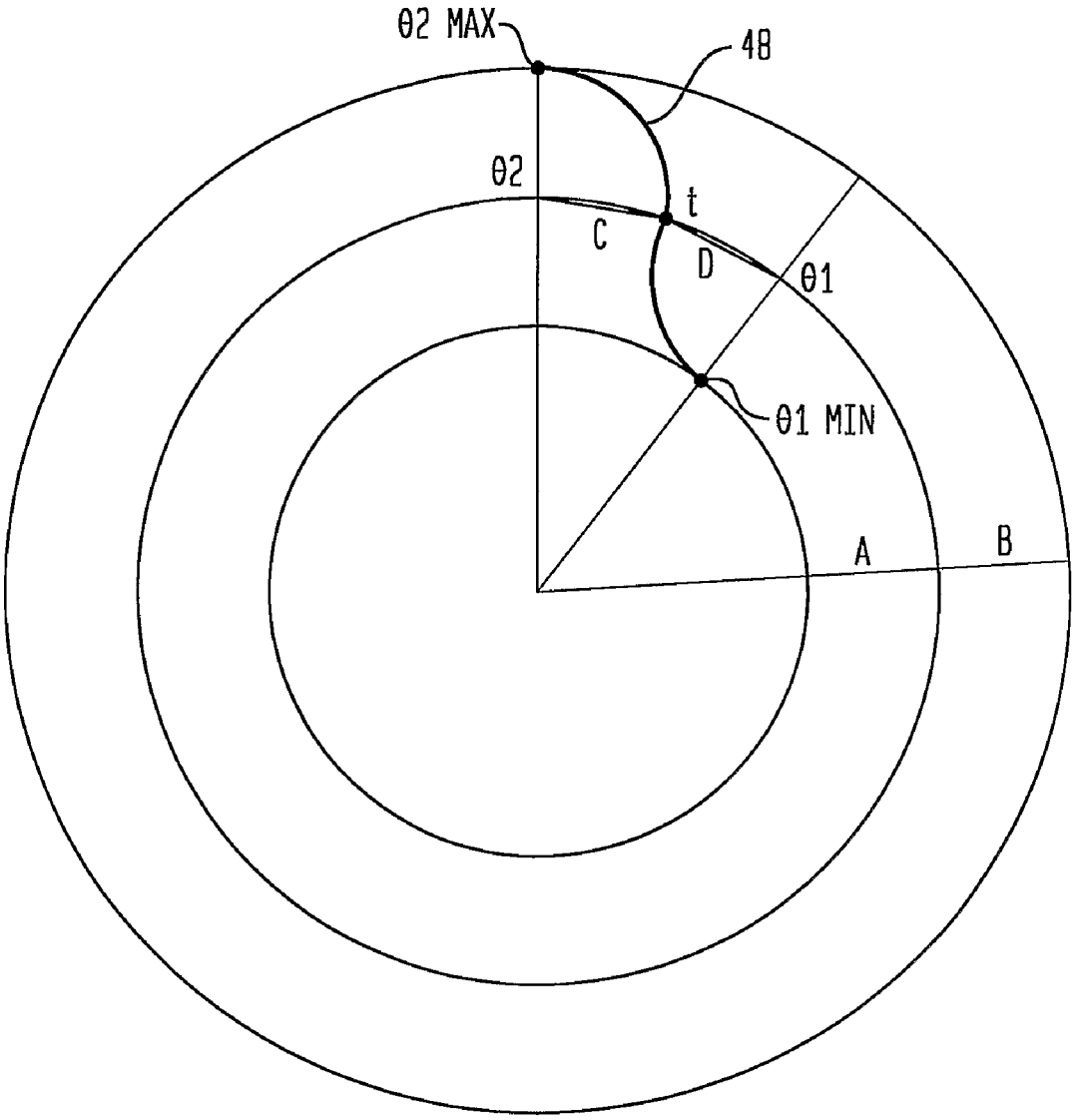
FIG. 10 illustrates the construction of a strand of the sliding, rotating seal and the manner in which the curves are generated.

There are some fundamental aspects of the invention which do not vary by specific application. FIGS. 8-10 highlight the operating properties which hold for the inventor's application regardless of whether it operates as a pump or motor embodiments 10 or 100.

FIG. 8 illustrates the screw component parts of embodiment 10, but are equally true for embodiment 100. Item 30 is the tapered core of the rotor, while 38 is the outer edge of a spiraled flight. Both are tapered towards the low pressure side in contrast to the prior art, where the tapers of the inner and outer surfaces are in opposite directions. The outer surface of the thread or spiral flight forms a unique rotating seal. The compression/expansion ratios can vary from 1:1 to 15:1.

FIGS. 9A-9G show the progressive movement of the sliding rotating seal 48, 68, 148, 168 of the S-shaped transition zone of each of the rotors. The invention, in all embodiments, maintains the sliding seal in all applications. The development of the seal is very useful. The construction of the S-shaped transition zone seal is illustrated in FIG. 10. With radius A, a compass with pivot on Θ1 swings an arc from t which lies on the middle circle of the figure to Θ1 Min which is at the intersection of the inner circle and the radial line passing through Θ1. The outer arc is made using Θ2 as the pivot, swinging an arc from t to Θ2Max which is at the intersection of the outer circle and the radial line segment passing through Θ2. Line segments A, B, C, and D are all of equal length. Additional complexities arise with the use of non-parallel axes. The solution found was to put each strand of the described seal on the surface of a sphere whose radius is from the intersection of the two axes. Each strand and its mate on the other screw have all the same measurements as well as distance from the axis intersection.

While the invention has been described with reference to the preferred embodiments, it will be appreciated by those of ordinary skill in the art that modifications can be made to the structure and operation of the invention without departing from the spirit and scope thereof as a whole.

I claim:

1. A self sealing twin rotor tapered screw pump apparatus (10) comprising:

a first tapered rotor (22) having a large end (32) and a small end (34), said first tapered rotor (22) further including a tapered core (30) and at least one spiral flight (36) surrounding said core (30) having a width that increases as said spiral flight (36) progresses from said larger end (32) to said smaller end (34);

a second tapered rotor (24) also having a large end (52) and a small end (54), said second tapered rotor (24) further including a tapered core (50) and at least one spiral flight (56) surrounding said tapered core (50) having a width that increases as said spiral flight (56) progresses from said larger end (52) to said smaller end (54), and wherein said spiral flight (56) of said second tapered rotor (24) rotates in a direction opposite from the direction of rotation of the spiral flight (36) on said first tapered rotor (22);

a pump housing (12) having two adjacent tapered cavities (14,18) therein for receiving said first and second tapered rotors (22,24) so that said tapered rotors (22,24) engage each other, said pump housing (12) further including a high pressure port (28) located adjacent said large ends (33,52) of said tapered rotors (22,24) and a low pressure port (26) located adjacent said small ends (34,54) of said tapered rotors (22,24), wherein rotation of one of said tapered rotors (22,24) causes fluid introduced into said low pressure side through port (26) to be pumped into said high pressure side and further wherein said fluid in said high pressure side pushes against the large ends (32,52) of said tapered rotors (22,24) forcing said tapered rotors (22,24) into sealing relationship with one or more walls (16,20) of said tapered cavities (14,18).

2. The pump apparatus (10) of claim 1 further comprising;

mounting means (42,62) for supporting said rotors (22,24) so that said rotors (22,24) move into or out of said tapered cavities (14,18) under the influence of the fluid on the high pressure side of the housing (12).

3. The pump apparatus (10) of claim 2 wherein said mounting means comprises:

a first and a second shaft (42,62,82) and further wherein each rotor (22,24) has a long axis and each rotor (22,24) further includes a cavity for receiving said first and second shafts, wherein said first and second rotors (22,24) and move longitudinally along said shafts in response to the pressure of the fluid on the high side of said pump housing (12).

4. The pump apparatus (10) of claim 3 wherein said shafts are splines (42,62) and said cavities (40, 60) in said rotors engage said splines so that said rotors (22,24) move in a direction parallel to said splines (42,62) but are not free to rotate with respect thereto.

5. The pump apparatus (10) of claim 4 wherein said first and second shafts are inclined at an angle in the range of 0° to 60° with respect to each other.

6. The pump apparatus (10) of claim 5 wherein one of said two shafts (42,62,82) is driven by a power source.

7. The pump apparatus (10) of claim 6 wherein said large end (32,52) of said rotors (22,24) has a face which is relatively flat and takes up more than 70% of the area of the cavity in which it sits when in sealing engagement with said cavity.

8. The pump apparatus (10) of claim 7 wherein said small ends (34,54) of said rotors (22,24) has a face that takes up more than 30% of the area of said low pressure side (22) but not more than 75% of said area.

9. The pump apparatus (10) of claim 8 wherein the faces of said small ends (34,54) of said rotors (22,24) have a profile comprising:

a large segment (44,64) of a circle which comes into sealing engagement with said cavity walls;

a small segment (46,66) of a circle larger than the diameter of said cavities in said rotors; and;

an S shaped transition zone (48,68) between said large segment (44,64) and said small segment (46,66), said S shaped transition zone (48,68) further comprising two circular segments facing in opposite directions.

10. The pump apparatus (10) of claim 9 wherein said first large segment (44) of said first rotor (22) contacts said small segment (66) of said second rotor (24) and said large segment (64) of said second rotor (24) contact said small segment (46) of said first rotor (22) and said transition zones (48,68) of said first and second rotors (22,24) contact each other as said first and second rotors (22,24) rotate.

11. The pump apparatus (10) of claim 10 wherein the volume change from low pressure side to high pressure side vary in ratio from 1:1 to 15:1.

12. The pump apparatus of claim 11 above, wherein up to four additional rotors of like kind are added, wherein one rotor drives up to five other rotors in a direction opposite to its own rotation.

13. A self sealing twin rotor tapered screw motor apparatus (100) comprising:

a first tapered rotor (122) having a large end (132) and a small end (134), said first tapered rotor (122) further including a tapered core (130) and at least one spiral flight (136) surrounding said core (130) having a width that increases as said spiral flight progresses from said larger end (132) to said smaller end (134);

a second tapered rotor (124) also having a large end (152) and a small end (154), said second tapered rotor (124) further including a tapered core (150) and at least one spiral flight (156) surrounding said tapered core (150)

having a width that increases as said spiral flight (156) progresses from said larger end (152) to said smaller end (154), and wherein said spiral flight (156) of said second tapered rotor (124) rotates in a direction opposite from the direction of rotation of the spiral flight (136) on said first tapered rotor (122);

a motor housing (112) having two adjacent tapered cavities (114,118) therein for receiving said first and second tapered rotors (122,124) so that said tapered rotors (122, 124) engage each other, said motor housing (112) further including a high pressure side port (128) located adjacent said large ends (133,152) of said tapered rotors (122,124) and a low pressure side port (126) located adjacent said small ends (134,154) of said tapered rotors (122,124), wherein of the introduction to said tapered rotors (122,124) from said high pressure side to rotate via expansion of the pressures within the screw cavities and further wherein said fluid in said high pressure side pushes against the large ends (132,152) of said tapered rotors (122,124) forcing said tapered rotors (122,124) into sealing relationship with one or more walls (116,120) of said tapered cavities (114,118).

14. The motor apparatus (100) of claim 13 further comprising;

mounting means (142,162) for supporting said rotors (122, 124) so that said rotors (122,124) move into or out of said tapered cavities (114,118) under the influence of the fluid on the high pressure side of the housing (112).

15. The motor apparatus (100) of claim 14 wherein said mounting means comprises:

a first and a second shaft (142,162,182) and further wherein each rotor (122,124) has a long axis and each rotor (122,124) further includes a cavity (140,160) for receiving said first and second shafts, wherein said first and second rotors (122,124) and move longitudinally along said shafts in response the pressure of the fluid on the high side of said motor housing (112).

16. The motor apparatus (100) of claim 15 wherein said shafts are splines (142,162), said cavities in said rotor engage said splines so that said rotors (122,124) move in a direction parallel to said splines (142,162) but are not free to rotate with respect thereto.

17. The motor apparatus (100) of claim 16 wherein said first and second shafts are inclined at an angle in the range of 0° to 60° with respect to each other.

18. The motor apparatus (100) of claim 17 wherein said large end (132,152) of said rotors (122,124) has a face which is relatively flat and takes up more than 70% of the area of the cavity in which it sits when in sealing engagement with said cavity.

19. The motor apparatus (100) of claim 18 wherein said small ends (134,154) of said rotors (122,124) has a face that takes up more than 30% of the area of said low pressure side (122) but not more than 75% of said area.

20. The motor apparatus (100) of claim 19 wherein the faces of said small ends (134,154) of said rotors (122,124) have a profile comprising:

a large segment (144,164) of a circle which comes into sealing engagement with said cavity walls; a small segment (146,166) of a circle larger than the diameter of said cavities in said rotors; and;

an S shaped transition zone (148,168) between said large segment (144,164) and said small segment (146,166), said S shaped transition zone (148,168) further comprising two circular segments facing in opposite directions.

21. The motor apparatus (100) of claim 20 wherein said first large segment (144) of said first rotor (122) contacts said small segment (166) of said second rotor (124) and said large segment (164) of said second rotor (124) contact said small segment (146) of said first rotor (122) and said transition zones (148, 168) of said first and second rotors (122,124) contact each other as said first and second rotors (122,124) rotate.

22. The motor apparatus (100) of claim 21 wherein the volume from low side to high side varies in ratio from 1:1 to 15:1.

23. The motor apparatus (100) of claim 22 wherein a control circuit (88) controls the speed and torque characteristics.

24. The motor of claim 13 above, wherein up to four additional rotors of like kind are added, wherein one rotor drives up to five other rotors in a direction opposite to its own rotation.

* * * * *